United States Patent [19]

Shima

[11] Patent Number: 4,905,483

[45] Date of Patent: Mar. 6, 1990

[54] FLAT KNITTING MACHINE

[75] Inventor: Masahiro Shima, Wakayama, Japan

[73] Assignee: Shima Seiki Mfg. Ltd., Wakayama, Japan

[21] Appl. No.: 238,353

[22] Filed: Aug. 29, 1988

[30] Foreign Application Priority Data

Sep. 4, 1987 [JP] Japan ..... 62-222236

[51] Int. Cl.[4] ..... D04B 7/00

[52] U.S. Cl. ..... 66/64; 66/66; 66/69

[58] Field of Search ..... 66/64, 66, 72, 69

[56] References Cited

U.S. PATENT DOCUMENTS 750,052 1/1904 Greaud ..... 66/64

FOREIGN PATENT DOCUMENTS 36382 12/1968 United Kingdom ..... 66/64

*Primary Examiner*—Ronald Feldbaum

*Attorney, Agent, or Firm*—Barnes, Kisselle, Raisch, Choate, Whittemore & Hulbert

[57] ABSTRACT

A flat knitting machine comprises four needle beds in the form of flat plates wherein a pair of front side and back side lower needle beds thereof are disposed in an inverted V-shape in side elevation with head portions thereof opposed to each other, and another pair of front side and back side upper needle beds thereof are disposed with head portions thereof positioned near the head portions of the respective lower needle beds and in an inclined relationship such that the head portions thereof may assume a little higher position.

3 Claims, 4 Drawing Sheets

FLAT KNITTING MACHINE

FIELD OF THE INVENTION

This invention relates to a flat knitting machine including four needle beds in the form of flat plates disposed with head portions thereof opposed to each other.

RELATED ART STATEMENT

In a flat knitting machine, such an arrangement is conventionally employed commonly that a pair of needle beds in the form of flat plates are disposed in an opposing relationship like a mounting such that head portions thereof may be positioned at the highest positions in order to knit a tubular fabric. And, further a knitting machine composed of four needle beds is disclosed in DE-OS 24 36 450 (Japanese Patent Laid-Open No. 51-36561) wherein, in order to develop, when a garment such as a sweater is to be made using a tubular knit fabric, design patterns on both of a fabric to form the front side of the garment when it is worn and another fabric to form the back side of the garment, a pair of upper needle beds are provided individually above a pair of lower needle beds disposed in an opposing relationship like a mountain such that a center line of a set of knitting devices constituted from one of the lower needle beds and one of the upper needle beds which opposes to the lower needle bed may cross another center line of another set of similarly constituted knitting devices.

In the knitting machine disclosed in DE-OS 24 36 450 mentioned above, the upper needle beds provided above the lower needle beds are disposed such that head portions thereof are lowered with respect to a horizontal position. Accordingly, when needles in one of the upper needle beds are operated to advance toward needles in one of the lower needle beds which is provided in an opposing relationship to the one upper needle bed, the other upper needle bed disposed in an opposing relationship to the one upper needle bed interferes with the needles of the one upper needle bed. Therefore, when the needles of the one upper needle bed are to be operated, the other upper needle bed must be retracted. Accordingly, a mechanism is required for advancing and retreating each of the upper needles beds.

With such an arrangement wherein upper needle beds are provided above main needle beds in an opposing relationship with head portions thereof inclined downwardly as described above, when needles of one of the upper needle beds are to be operated, the other upper needle bed will interfere with the needles, and accordingly, the needles of the one upper needle bed cannot be advanced. Therefore, a device must be provided for advancing and retracting each of the upper needle beds.

OBJECT AND SUMMARY OF THE INVENTION

It is an object of the present invention to concentrate head portions of four needle beds so as to enable needles of the upper needle beds to be operated without the necessity of an advancing and retracting device for each of the upper needle beds.

A flat knitting machine comprises four needle beds in the form of flat plates wherein a pair of front side and back side lower needle beds thereof are disposed in an inverted V-shape in side elevation with head portions thereof opposed to each other, and another pair of front side and back side upper needle beds thereof are disposed with head portions thereof positioned near the head portions of the respective lower needle beds and in an inclined relationship by an angle of 5 to 10 degrees with respect to a horizontal plane such that the head portions thereof may assume a little higher position.

When a fabric is to be knit with a combination of one of the front side needle beds and one of the back side needle beds among the front side lower needle bed, front side upper needle bed, back side lower needle bed and back side upper needle bed which are arranged with the head portions thereof concentrated, even if the needles of the upper needle bed are advanced, the advanced needle will be advanced toward locations above the needles of the opposing upper needle bed because the upper needle bed and the opposing upper needle bed are provided in an inclined relationship by an angle of 5 to 10 degrees with respect to a horizontal plane such that the head portions thereof may assume a little higher position. Accordingly, the opposing needles and the opposing needle bed will not interfere with the advanced needles.

DETAILED DESCRIPTION OF PREFERRED EMBODIMENTS

Figure 1:
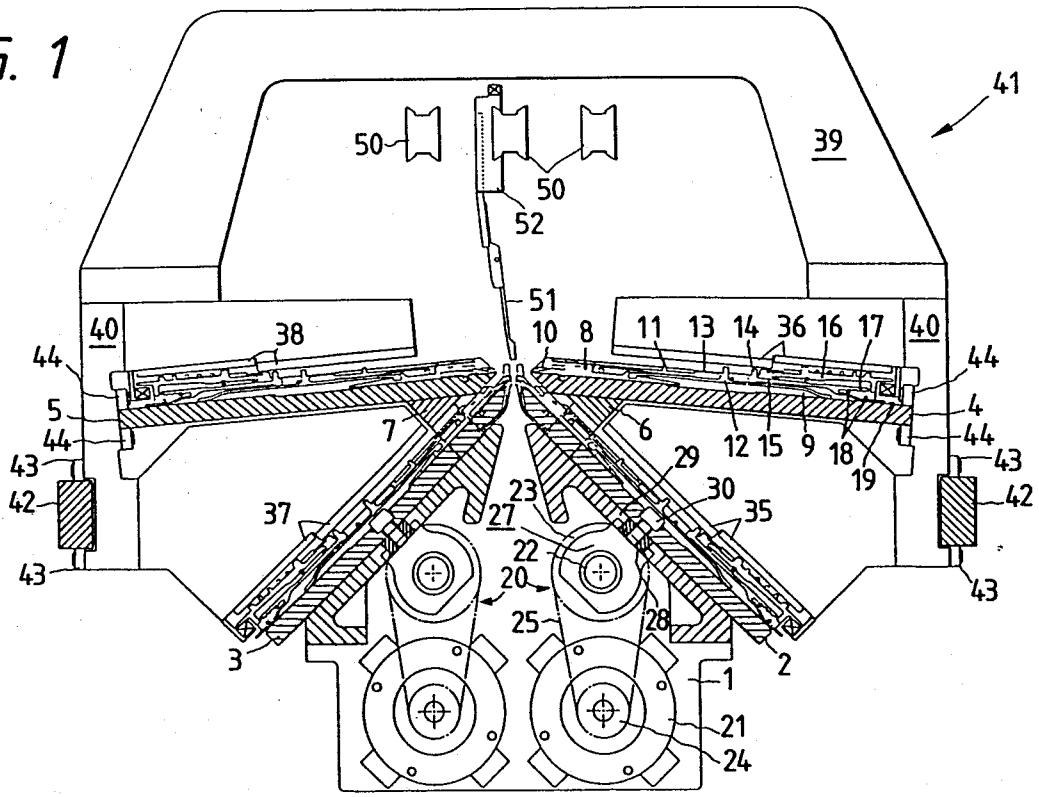
FIG. 1 is a vertical sectional side elevational view of a flat knitting machine according to the present invention.
Figure 2:
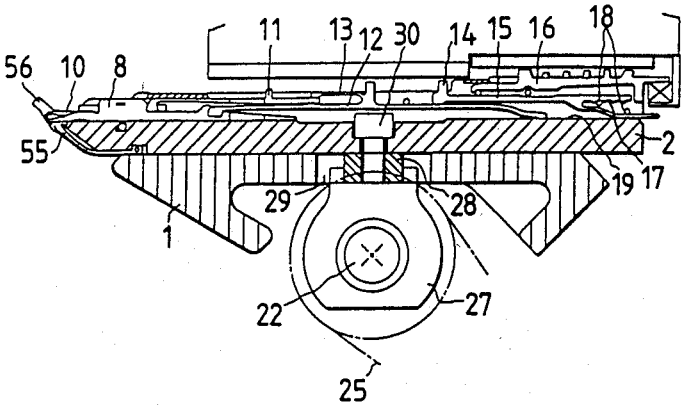
FIG. 2 is a vertical sectional side elevational view of a front side lower needle bed, FIG. 3 an enlarged vertical sectional side elevational view of sinker portions of the four beds.

An embodiment of an arrangement of the present invention will be described below with reference to the drawings.

The arrangement of the present invention includes a pair of front side and back side lower needle beds 2, 3 in the form of flat plates supported on a body bed 1 with head portions thereof arranged in a confronting relationship by an angle of 90 degrees. A pair of front side and back side upper needle beds 4, 5 are provided above the lower needle beds 2, 3, respectively, and supported in an inverted flattened V-shaped arrangement by means of a pair of support arms 6, 7 branched from the body bed 1 such that front ends thereof are disposed near the head portions of the lower needle beds, 2, 3, respectively, and rear ends thereof are inclined downwardly by an angle of 5 to 10 degrees with respect to a horizontal plane.

The needle beds 2, 3, 4, 5 are similar to each other in that each of them has needles 8 and so on inserted in needle grooves 9 thereof. The needles 8 inserted in the needle beds 2, 3, 4, 5 are denoted 8FD, 8BD, 8FU, 8BU, respectively. The needles 8 are compound needles each including a slider 10 which engages with a slider jack 11. The slider jack 11 is held for sliding movement between a holding arm 13 provided on a jack 12 of each needle 8 and a shank of the jack 12. A select jack 15 and a selector 16 are further inserted in each needle groove 9. The select jack 15 is forked at a tail end portion thereof, and the upper one of the forked legs of the select jack 15 has a plurality of positioning recesses 17 formed thereof for engaging with one of a pair of needle plate wires 18 while the lower leg contacts with the other needle wire 18 and a bottom portion 19 of the needle groove 9 and acts as a spring for urging a select jack butt 14 in a direction to project.

A racking device 20 is provided for each of the front side lower needle bed 2 and the back side lower needle bed 3. Since the racking devices 20 have a common structure to the front side and back side lower needle beds 2, 3, description will be given of the racking device 20 for the front side lower needle bed 2. A stepping motor 21 and a ball screw 22 are supported on the body bed 1. A belt 25 extends between a follower pulley 23 secured to the ball screw 22 and a drive pulley 24 of the stepping motor 21. A ball screw flange 27 is held in threaded engagement with the ball screw 22, and a racking sliding plate 28 is secured to the ball screw flange 27. The racking sliding plate 28 is located in an elongated hole 29 formed in a lower needle bed receiving wall of the body bed 1 and extends in the longitudinal direction of the bed, and the front side lower needle bed 2 is secured to the racking sliding plate 28 by means of a screw 30. Accordingly, rotation of the stepping motor 21 is transmitted to the front side lower needle bed 2 via the drive pulley 24, belt 25, follower pulley 23, ball screw 22, ball screw flange 27 and racking sliding plate 28 to make a racking motion of the lower front side needle bed 2 by required pitches. A carriage 41, which has a cam set 35 for the front side lower needle bed, another cam set 36 for the front side upper needle bed, a further cam set 37 for the back side lower needle bed and a still further cam set 38 for the back side upper needle bed for operating the needles 8 and so on of the individual needle beds including the front side lower needle bed 2, back side lower needle bed 3, front side upper needle bed 4 and back side upper needle bed 5 and in which the cam sets are connected to each other by means of a gate 39 and a pair of connecting arms 40, is supported on a pair of guide rails 42 such that it may travel along the needle beds 2, 3, 4, 5. Reference numerals 43, 43 denote a pair of bearing rollers for holding each of the guide rails 42 therebetween. A pair of bearing rollers 44, 44 are also provided intermediately on each of the connecting arms 40, and an end portion of each of the front side and back side upper needle beds 4, 5 is held between the bearing rollers 44, 44 so that the front side and back side upper needle beds 4, 5 may be supported at the opposite ends at the head and tail portions thereof together with the support arms 6, 7. If the upper needle beds 4, 5 are supported at the opposite end portions thereof in the longitudinal direction on the body bed, there is the possibility that the tail end portions at the central portions may be lowered by the weight thereof so that the tail end portions may exhibit an arcuate shape as a whole. In this instance, since the head portions do not present a change because they are secured by the support arms 6, 7, it is supposed that the advancing direction of the needles may be directed in an upper direction than the normal direction because the tail portions are lowered. Thus, if the tail end edges of the needle beds are supported by means of the bearing rollers 44, 44 of the carriage 41, then the needle beds are supported at portions thereof near locations at which the needles being operated actually are inserted, and accordingly, there is no possibility of such displacement by weight as described above.

Reference numeral 50 denotes a guide rail for a carrier 52 having a yarn feeder 51 thereof, and some of the carriers and the yarn feeders are omitted.

Figure 3:
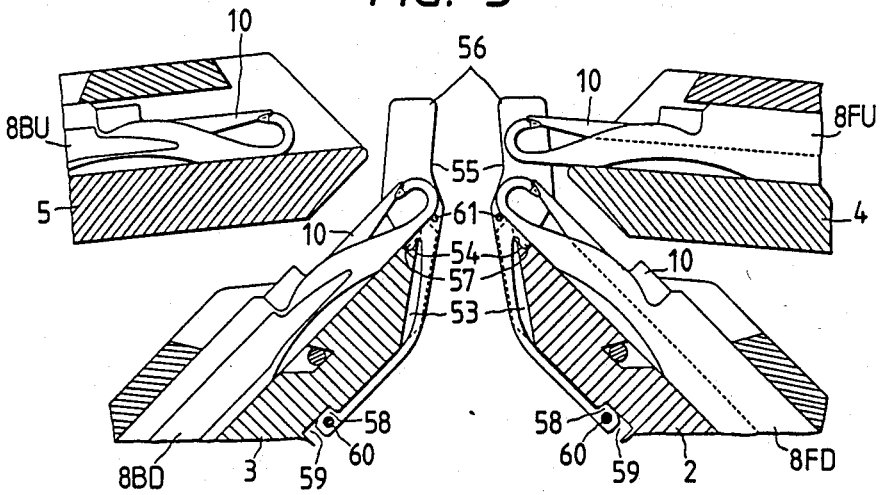

At the head end portions of the front side and back side lower needle beds 2, 3 among the four needle beds, sinker plate grooves 53 are formed in a spaced relationship by a distance equal to the pitch of the needles as shown in FIG. 3, and a pair of hooked portions 54 are provided in the longitudinal redirection of the head portions. Each of the sinker plates 55 has an elongated top portion 56 in the form of a plate, a stepped portion 47 at a lower portion of the plate-formed top portion 56, and an engaging projection 58 at the lower end thereof. The sinker plate 55 is integrated with the front side lower needle bed 2 by engaging the stepped portion 57 thereof with the hooked portion 54 of the needle bed, arresting the lower end engaging projection 58 at a recessed portion 59 provided on a lower wall of the needle bed, and threading a sinker fixing wire 60 through the engaging projection 58. Reference numeral 61 denotes a sinker wire. With the sinker plates 55 provided on the lower needle beds 2, 3 in such a manner as described above, the plate-formed top portions 56 thereof are positioned in front of the upper needle beds 4, 5 and act to handle a knit fabric when the fabric is being knit with the needles 8FU, 8BU. Accordingly, no sinker plates are provided on either of the front side and back side upper needle beds 4, 5. Therefore, since means for providing sinkers is not necessary at least at the head portions of the upper needle beds near sinker portions around which the head portions of the four beds are concentrated, the head portions can be concentrated in a small space. This has an influence on the knit fabric.

The needles which are normally used in the device of the present invention are compound needles which are provided with stitch transfer springs. While a latch needle requires thereabove a space at least equal to the range of an arcuate locus drawn by an end of the latch thereof because the latch is pivoted backwardly upon formation of a loop, it is not preferable in the case of the knitting machine of the present invention to provide such a space for pivoting back movement of the latch for the lower needle beds because the upper needles are positioned above the lower needles in an inclined relationship by an angle of 5 to 10 degrees with respect to a horizontal plane such that the head portions thereof may assume a higher position. Further, for the above described object of concentrating the head portions of the needle beds, and besides in order to raise the needle operating speed, compound needles are used in the device of the present invention.

When a fabric is to be knit on the device of the present invention, there are various combinations including a combination of the two front side and back side lower needle beds 2, 3, another combination of the back side lower needle bed 3 and the front side upper needle bed 4 and a further combination of the front side lower needle bed 2 and the back side upper needle bed 5, and whichever combination is used, the combination is determined depending upon the structure of a fabric to be knit.

Now, the procedure of knitting a tubular knit fabric of a $1\times1$ rib stitch will be described as an example of simplest stitch structure.

Advancing and retracting movement of the needles, sliding operation of the sliders and so on upon such knitting are similar to those in a conventional device in that they are all performed by operation of the cam sets 35, 36, 37, 38 as the carriage 41 is moved In knitting a tubular fabric on the device of the present invention, when a structure of one face of such tubular knit fabric, for example, of a front side of the knit fabric (front side of the knitting machine) is to be knit, the front side lower needle bed 2 and the back side upper needle bed 5 are used for knitting, and when a structure of a rear side of the tubular knit fabric (back side of the knitting machine) is to be knit, the back side lower needle bed 3 and the front side upper needle bed 4 are used for knittiing. Accordingly, when the carriage is reversed to knit the structure of on one side after completion of knitting of the structure of the other side, the already knit fabric must be transferred to the other side.

To this end, where the carriage used is, for example, of the 4 lock type, such an example may be recommended that transfer of loops is performed by the left and right locks while knitting is performed by the two central locks, and one face of the tubular fabric is knit by 2 courses during one stroke of the carriage and then the other face of the tubular fabric is knit by 2 courses during a next stroke after reversal of the carriage.

Figure 4:
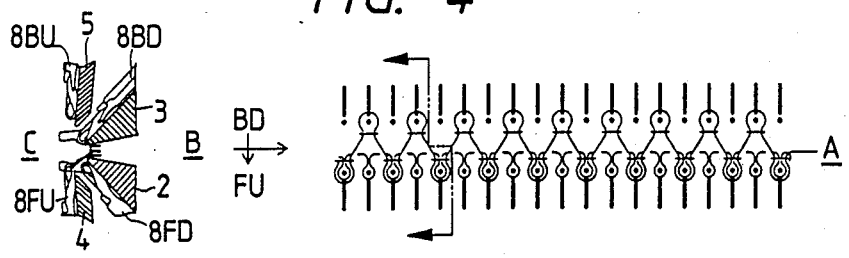
FIGS. 4 to 11 illustrate a procedure of knitting fabric, and in each of the figures, A is a plan view of the sinker portions, B an explanatory view, illustrating a loop transferring direction and a carriage moving direction, and C a sectional view taken along an indicative line of each figure A.
Figure 5:
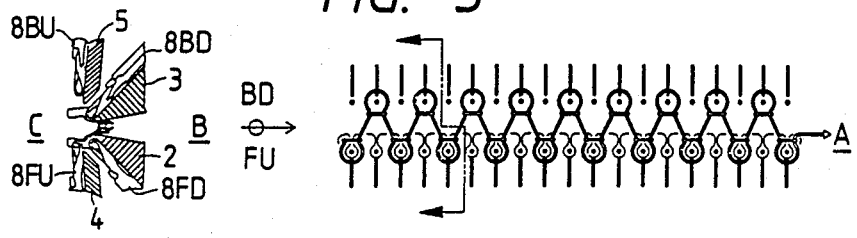
Figure 6:
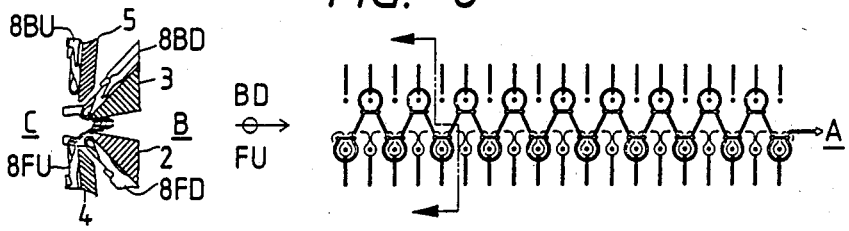
Figure 7:
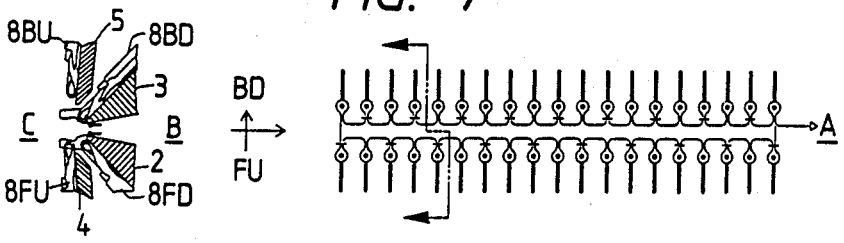

Such an example is illustrated in FIGS. 4 to 11. While a back side knit fabric of a tubular knit fabric is knit upon movement of the carriage in the rightward direction, at first ever other loops of the back side fabric hung on the needles 8BD of the back side lower needle bed 3 are transferred from the needles 8BD to the needles 8FU of the front side upper needle bed 4 by the leading lock of the 4 lock carriage (FIG. 4). In FIG. 4, black circles and verticle lines shown on an upper stage represent the back side upper and lower needles 8BU and 8BD (both are positionally overlapping), respectively, while black circles and vertical lines shown on a lower stage represent the front side upper and lower needles 8FU and 8FD (both are positionally overlapping), respectively. Accordingly, in a double loop at the left end on the lower stage, an outer greater diameter loop represents a loop transferred from a needle 8BD to another needle 8FU, and an inner smaller diameter loop represents a loop produced on a needle 8FD. The second lock of the carriage knits loops for the first course of the rightward movement of the carriage with the needles 8FU of the front side upper needle bed 4 and the needles 8BD of the back side lower needle bed 3 (FIG. 5). The subsequent third lock also knits loops for the second course of the rightward movement of the carriage similarly with the needles 8FU and the needles 8BD (FIG. 6). By this, knitting of the back side of the tubular fabric is effected. The subsequent fourth lock does not effect knitting but performs transfer of loops such that the loops of the wales which have formerly been transferred from the needles 8BD of the back side lower needle bed 3 to the needles 8FU of the front side upper needle bed 4 are now transferred from the needles 8FU of the front side upper needle bed 4 to the needles 8BD of the back side lower needle bed 3. This transfer of the loops returns the loops which have been formerly transferred from the back side lower needles 8BD to the front side upper needles by the first lock now to the original back side lower needles 8BD. Consequently, the back side of the tubular fabric is hung on and knit down with the back side lower needles 8BD while the front side of the tubular fabric is hung on and knit down with the front side lower needles 8FD.

Figure 8:
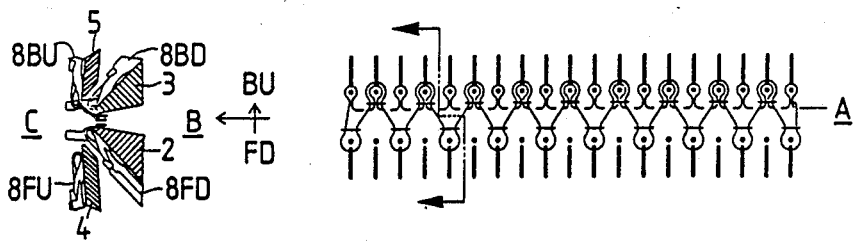
Figure 9:
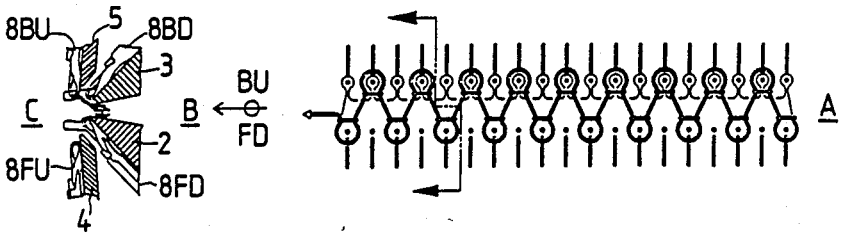
Figure 10:
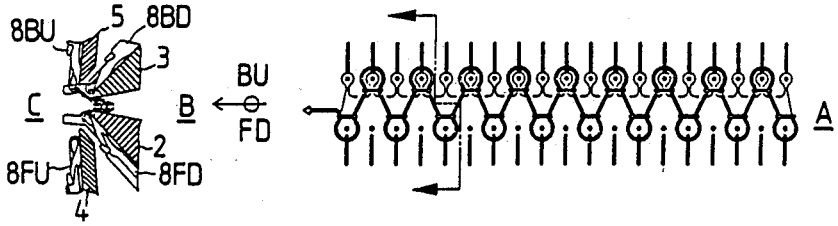
Figure 11:
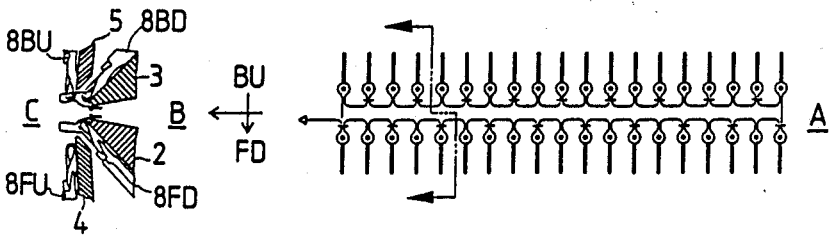

Subsequently, if the carriage is reversed and now moved leftwardly, the lock at the trailing end upon the rightward movement of the carriage, that is, the fourth lock upon the rightward movement, now serves as the first lock so that loops are transferred from the needles 8FD of the front side lower needle bed 2 to the needles 8BU of the back side upper needle bed 5 (FIG. 8). This transfer is performed with the needles of wales adjacent the wales for which the transfer of the loops has been performed initially upon the preceding rightward movement of the carriage. By the following second lock and third lock, knitting of the front side of the tubular fabric is performed with the front side lower needles 8FD and the back side upper needles 8BU (FIG. 9) (FIG. 10), and by the following fourth lock, the loops of the wales for which the loops have been transferred upon starting of the leftward movement are transferred from the back side upper needles 8BU to the front side lower needles 8FD, thereby completing a reciprocal movement of the carriage. During such reciprocal movement of the carriage, the front side and the back side of the tubular fabric are knit by 2 courses for each of the rightward and leftward movements.

When the needles of one of the front side and back side upper needle beds cooperate with the needles of an opposing one of the back and front side lower needle beds to knit a fabric, even if the upper needles are advanced, the advanced upper needles are advanced toward locations above the opposing upper needle bed and the opposing upper needles and hence will not be contacted with them because the opposing upper needle bed is inclined such that the head portion thereof may assume a highest position and the tail portion thereof may be lowered by an angle of 5 to 10 degrees with respect to a horizontal plane. Accordingly, when the needles of the opposing upper needle bed are advanced, there is no necessity of retracting the opposite needle bed.

Accordingly, there is no necessity of provision of an upper needle bed advancing and retracing device for it.

Further, since the heads of the four needle beds can be concentrated near to each other, this has an influence on the size of loops of a knit fabric, and a knit fabric having a high stitch density can be produced.

What is claimed is:

1. A flat knitting machine comprising:

(a) a body bed, (b) a first pair of front side and back side lower needle beds disposed in an inverted V-shape in side elevation mounted on said body bed for reciprocation thereon, said needle beds having adjacent head portions, (c) means for reciprocating said first pair of needle beds to shift said head ends and actuate needle cam sets on said first pair of needle beds, (d) a second pair of front side and back side upper needle beds on said body bed disposed with head portions positioned near said head portions of said lower needle beds and in a downwardly inclined relationship with respect to a horizontal plane such that the head portions of said second pair are in a higher position than the head portion of said first pair, means on said body bed supporting the second pair of needle beds at the head ends, (e) each side needle beds of said second pair having a tail end opposite the head end, (f) a carriage means slidably mounted relative to said body bed and said needle beds movable in a direction transverse to said needle beds to actuate the cam sets on said first pair of needle beds and on said secod pair of needle beds, and (g) means on said carriage to support the tail ends respectively of said second pair of needle beds comprising bearing rollers on said carriage interengaged with said tail ends to support said tail ends in a stationary position while said carriage reciprocates.

2. A knitting mechanism as defined in claim 1 in which the angle of inclination of the upper needle beds is 5° to 10° from horizontal.

3. A flat knitting machine as defined in claim 1 in which each said lower needle bed supports a sinker plate, said sinker plates having upstanding elongate portions in the form of a plate spaced and extending to a location in front of said head ends of said upper needle beds at the area between said needle beds to handle a knit fabric while being knitted.

* * * * *